United States Patent [19]

Okumoto et al.

[11] Patent Number: 4,619,277

[45] Date of Patent: Oct. 28, 1986

[54] TOBACCO FILTER TIP ATTACHING APPARATUS

[75] Inventors: Yutaka Okumoto, Musashino; Toshiyuki Ozaki, Tokyo; Mikio Komori, Matsudo, all of Japan

[73] Assignee: The Japan Tobacco & Salt Public Corporation, Tokyo, Japan

[21] Appl. No.: 686,867

[22] Filed: Dec. 27, 1984

[30] Foreign Application Priority Data

Dec. 27, 1983 [JP] Japan ..... 58-244868

[51] Int. Cl.[4] ..... A24C 5/52

[52] U.S. Cl. ..... 131/94; 131/910

[58] Field of Search ..... 131/94, 95, 906, 907, 131/909, 910, 280, 84.1, 84.3, 84.4

[56] References Cited

U.S. PATENT DOCUMENTS

| | | | |
|---|---|---|---|
| 3,690,327 | 9/1972 | Heitmann | 131/94 |
| 4,044,779 | 8/1977 | Preston et al. | 131/94 |
| 4,077,415 | 3/1978 | Preston et al. | 131/94 |
| 4,403,620 | 9/1983 | Joseph et al. | 131/94 |

*Primary Examiner*—V. Millin
*Assistant Examiner*—H. Macey
*Attorney, Agent, or Firm*—Armstrong, Nikaido, Marmelstein & Kubovcik

[57] ABSTRACT

A tobacco filter tip attaching apparatus including a filter tip attaching portion for rolling and pasting a tip paper onto both one end portion of a cigarette and a filter tip disposed adjacent thereto, a filter tip feed portion disposed in the vicinity of the filter tip attaching portion for feeding filter tips to the filter tip attaching portion, a tip paper feed portion disposed in the vicinity of the filter tip attaching portion for feeding a tip paper from a tip paper roll to the filter tip attaching portion, a filter tip sensor for detecting that the feed of filter tip from the filter tip feed portion to the filter tip attaching portion is discontinued, a tip paper cutting sensor for detecting a cutting accident of the tip paper during feed from the tip paper feed portion to the filter tip attaching portion, and a roll diameter sensor for detecting that the diameter of the tip paper roll in the tip paper feed portion has become smaller than a predetermined value. The whole of the apparatus is covered. The cover is provided with openable doors in positions corresponding respectively to the filter tip feed portion, filter tip attaching portion and tip paper feed portion. Provided in corresponding relation to those doors are power sources, which are operated selectively in accordance with output signals provided from the above sensors to open one or more of the doors automatically.

1 Claim, 18 Drawing Figures

TOBACCO FILTER TIP ATTACHING APPARATUS

BACKGROUND OF THE INVENTION

The present invention relates to an apparatus for attaching a filter tip to cigarette of a predetermined length manufactured by a tobacco paper rolling machine.

In recent tobacco paper rolling machines, speed-up of operation is remarkable, and even a machine capable of manufacturing more than 8,000 cigarettes per minute has been developed. At the same time, apparatus for attaching filter tips successively to cigarettes manufactured by such tobacco paper rolling machines are also speeding up in operation. However, with speed-up of operation, the noise from the tobacco filter tip attaching apparatus in operation has been becoming larger even to an extent exceeding the standard level based on the noise regulation which is yearly becoming severer.

The simplest measure against such noise is to cover the whole of the apparatus. But, in this apparatus it is necessary for the operator to perform various works for each part of the apparatus while stopping operation temporarily, and therefore the cover must be provided with openable doors in positions corresponding to such various portions of the apparatus.

In the conventional tobacco filter tip attaching apparatus, when the operation stops, the operator judges which of plural doors should be opened according to the cause, and manually opens the door and closes it after completion of the work required. Consequently, even a door not be opened is often opened erroneously, and from the time when the operator opens the correct door corresponding to the cause and completes the required work until when he closes the door, a very troublesome extra work is required in addition to the very work required. Thus, the working efficiency is poor.

SUMMARY OF THE INVENTION

The present invention has been accomplished in order to eliminate the above-mentioned drawbacks of the prior art, and it is the object thereof to provide a tobacco filter tip attaching apparatus in which doors each adapted to be opened and closed by operation of a power source are provided in positions corresponding to various portions of the apparatus, and the doors of which should be opened is judged on the basis of outputs of sensors disposed in various portions of the apparatus, and the power source corresponding to that door is operated in accordance with the result of the judgment to open automatically the door corresponding to the portion of the apparatus where the required work must be done, whereby the manual door opening by the operator is eliminated to improve the working efficiency.

BRIEF DESCRIPTION OF THE DRAWINGS

The drawings illustrate an embodiment of the present invention, in which.

DESCRIPTION OF THE PREFERRED EMBODIMENT

An embodiment of the present invention will be described hereinunder with reference to the drawings.

Figure 1:
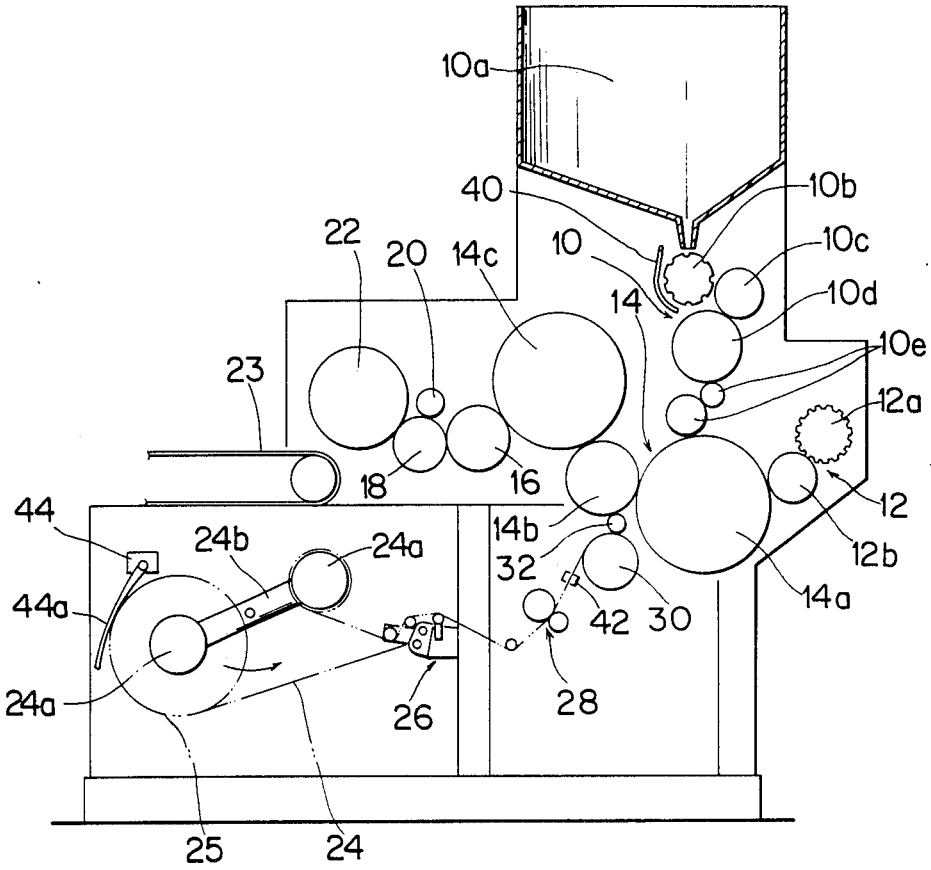
FIG. 1 is a schematic front view showing an example of a tobacco filter tip attaching apparatus to which the invention is applied.
Figure 2:
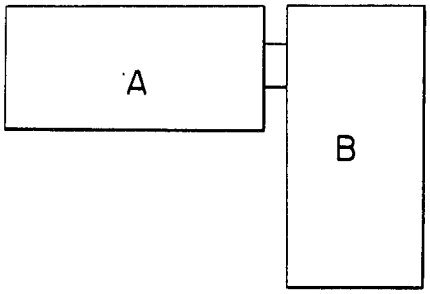
FIG. 2 is a layout diagram showing a positional relationship between the apparatus of FIG. 1 and a tobacco paper rolling machine.

FIG. 1 is a schematic front view of a tobacco filter tip attaching apparatus to which the invention is applied. This tobacco filter tip attaching apparatus indicated at A, as shown in FIG. 2, is connected to a tobacco paper rolling machine B which rolls shredded tobacco leaves with a rolling paper, and cigarettes of a predetermined length manufactured by the tobacco paper rolling machine B are fed successively to the apparatus A.

Figure 3A:
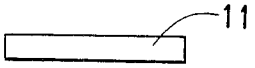
FIGS. 3*a* to 6*b* are views for explaining operations of various port:ons of the apparatus of FIG. 1.
Figure 3B:
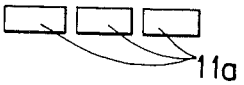
Figure 3C:
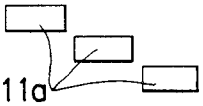
Figure 3D:
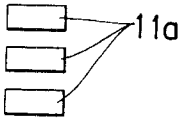

In FIG. 1, the numeral 10 denotes a tobacco filter tip feed portion. The filter tip feed portion 10 comprises a hopper 10*a* which contains a large number of filter plugs each having a length three times as large as the filter tip, a cutter drum 10*b* for cutting a filter plug 11 having such a length as shown in FIG. 3*a* received one by one from the hopper 10*a* into filter tips 11*a* each having a length one-third of the filter plug 11 as shown in FIG. 3*b*, a grading drum 10*c* for shifting in relative position the filter tips 11*a* trisected in the cutter drum 10*b*, as shown in FIG. 3*c*, an aligning drum 10*d* aligning as shown in FIG. 3*d* the three filter tips which have been shifted in relative position by the grading drum 10*c*, and a delivery drum 10*e* for delivering one by one the thus-aligned filter tips 11*a*.

Figure 4A:
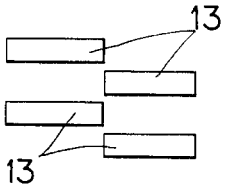
Figure 4B:
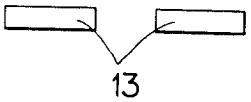

The numeral 12 denotes a cigarette feed portion. The cigarette feed portion 12 comprises a receiving drum 12*a* which receives in such a zigzag form as shown in FIG. 4*a*cigarettes 13 fed from the tobacco paper rolling machine B, and a grading drum 12*b* for rearranging the cigarettes received by the receiving drum 12*a* into a spaced form to an extent permitting interposition of a single filter tip as shown in FIG. 4*b* and delivering the same.

Figure 5A:
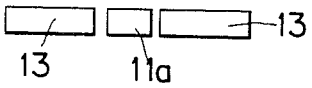
Figure 5B:
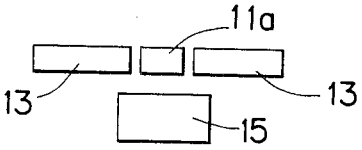
Figure 5C:
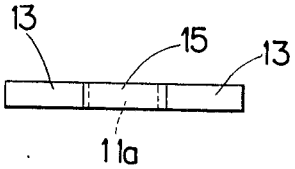

The numeral 14 denotes a filter tip attaching portion. The filter tip attaching portion 14 comprises a hopper drum 14*a* which receives two cigarettes 13 spaced from each other as shown in FIG. 4*b* from the grading drum 12*b* in the cigarette feed portion 12 and which receives between the two cigarettes 13 the filter tip 11*a* delivered from the delivery drum 10*e* in the filter tip feed portion 10, as shown in FIG. 5*a*, a transfer drum 14*b* which receives a predetermined length of a tip paper 15 with paste fed from a later-described tip paper feed portion and also receives the cigarettes 13 and filter tip 11*a* from the hopper drum 14*a* in such a state as shown in FIG. 5*b* and transfers them to the next rolling step, and a rolling drum 14*c* for rolling and pasting the tip paper 15 onto the filter tip 11*a* and the portions of the cigarettes 13 adjacent thereto as shown in FIG. 5*c*.

The numeral 16 denotes an inspection drum for checking the pasted state of the tip paper 15 rolled onto the two cigarettes 13 and filter tip 11*a* in the filter tip attaching portion 14 and detecting a defect.

Figure 6A:
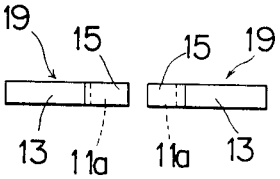

The numeral 18 denotes a cutter drum for cutting the cigarette with filter tip obtained in the filter tip attaching portion 14 and comprising two cigarettes 13 and one filter tip 11*a* attached in common thereto, at the center of the tip paper 15 to obtain two regular cigarettes 19 with filter tip as shown in FIG. 6*a*.

Figure 6B:
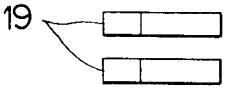

The numerals 20 and 22 denote an aligning drum and an inverting drum, respectively. By these drums, the two cigarettes 10 with filter tip which are in such a state as shown in FIG. 6*a* are inverted and aligned into such a state as shown in FIG. 6*b* and then delivered successively onto a belt conveyor 23, which in turn transfers the cigarettes 19 with filter tip to the next packing step.

The numeral 24 denotes a tip paper feed portion for feeding the tip paper of a predetermined length with paste to the filter tip attaching portion 14. The tip paper feed portion has a pair of tip paper roll loading bobbins 24*a* which are rotatably supported by a rotation support frame 24*b*. Usually, tip paper is delivered from a tip paper roll 25 loaded on the left-hand bobbin 24*a*. When the diameter of the roll 25 becomes smaller than a predetermined value, the support frame 24*b* is rotated 180 degrees in the direction of arrow as illustrated to move the roll 25 to the right-hand bobbin position. The roll of the bobbin which has been moved to the right-hand side with the said rotation is allowed to feed tip paper in that position, while a new tip paper roll is loaded onto the bobbin which has come to the left side. The diameter of the right-hand tip paper roll is small and the tip paper thereof will run out before long, so in order that the feed of tip paper may not be discontinued at that time, the fore end of tip paper of a new tip paper roll is set to a predetermined position in an automatic paper connecting portion 26, whereby the fore end of the new tip paper is automatically connected to the rear end of tip paper of the smaller-diameter roll when the latter has run out.

The numeral 28 denotes a pasting portion for pasting one side of tip paper fed to the filter tip attaching portion 14; the numeral 30 denotes a cutter portion for cutting the pasted tip paper into a predetermined length; and the numeral 32 denotes a suction roller for sucking the pasted tip paper 15 of a predetermined length and feeding it onto transfer drum 14*b*.

In the tobacco filter tip attaching apparatus of the above construction, it becomes necessary for the operator to perform works when various portions of the apparatus have assumed predetermined states.

Figure 7:
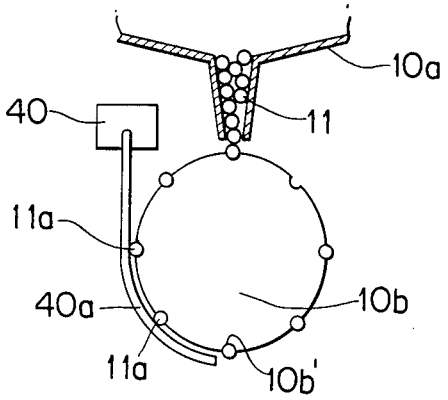
FIG. 7 is an enlarged view of a portion of the apparatus of FIG. 1.

One of such states is a state in which the feed of filter plug from the filter plug feed portion 10 stops due to clogging of the outlet portion of the hopper 10*a* with filter plugs and therefore the feed of filter tip 11*a* to the filter tip attaching portion 14 is no longer continued. In such a state, the apparatus will continue to make defective products during stoppage of the feed of filter tip, so it is necessary to immediately stop the operation of the apparatus temporarily and remove the filter plugs which cause clogging. To this end, in the vicinity of the cutter drum 10*b* of the filter tip feed portion 10 is disposed a plug clogging sensor 40 which detects stoppage of feed of, for example, two consecutive filter plugs from the hopper 10*a* and thereby detects a plug clogging. As the sensor 40 there is used a limit switch having a movable piece 40*a* of a shape which permits a simultaneous contact of the movable piece with filter plugs in two adjacent plug receiving recesses 10*b*' formed in the surface of the cutter drum 10*b* as shown in FIG. 7.

Secondly, when in the tip paper feed portion 24 the tip paper from the tip paper roll is cut in a position closer to the roll than the cutter drum 30, the tip paper can no longer be fed to the transfer drum 14*b* and so the products obtained will be defective. In such a state, it is necessary to immediately stop the operation of the apparatus temporarily and set the fore end of tip paper to a predetermined position on the cutter drum 30. To this end, a cutting sensor 42 for detecting a cutting accident of the tip paper is provided in the tip paper feed passage extending from the pasting portion 28 to the cutter drum 30. As the sensor 40 there is used a photo coupler comprising a light emitting element and a light receiving element which are opposed to each other on both sides of the tip paper feed passage.

Thirdly, when the diameter of the tip paper roll 25 located on the left-hand bobbin 24*a* of the tip paper feed portion 24 becomes smaller than the predetermined value, it is necessary to move the roll reduced in diameter to the right-hand side, load a new tip paper roll onto the left-hand side bobbin and perform a predetermined setting work for allowing the leading end of a new roll to be automatically connected to the terminal end of the tip paper of the reduced-diameter roll when the latter has run out. To this end, there is used a roll diameter sensor 44 for detecting that the diameter of the left-hand tip paper roll has become smaller than the predetermined value. As the sensor 44 there is used, for example, a limit switch having a movable contact lever 44*a* adapted to move along the outer periphery of the tip paper roll 25 loaded on the left-hand bobbin 24*a*, as shown in FIG. 1, or a rotary encoder adapted to rotate together with the bobbin 24*a* to detect a number of revolutions of the bobbins exceeding a predetermined value.

Figure 8:
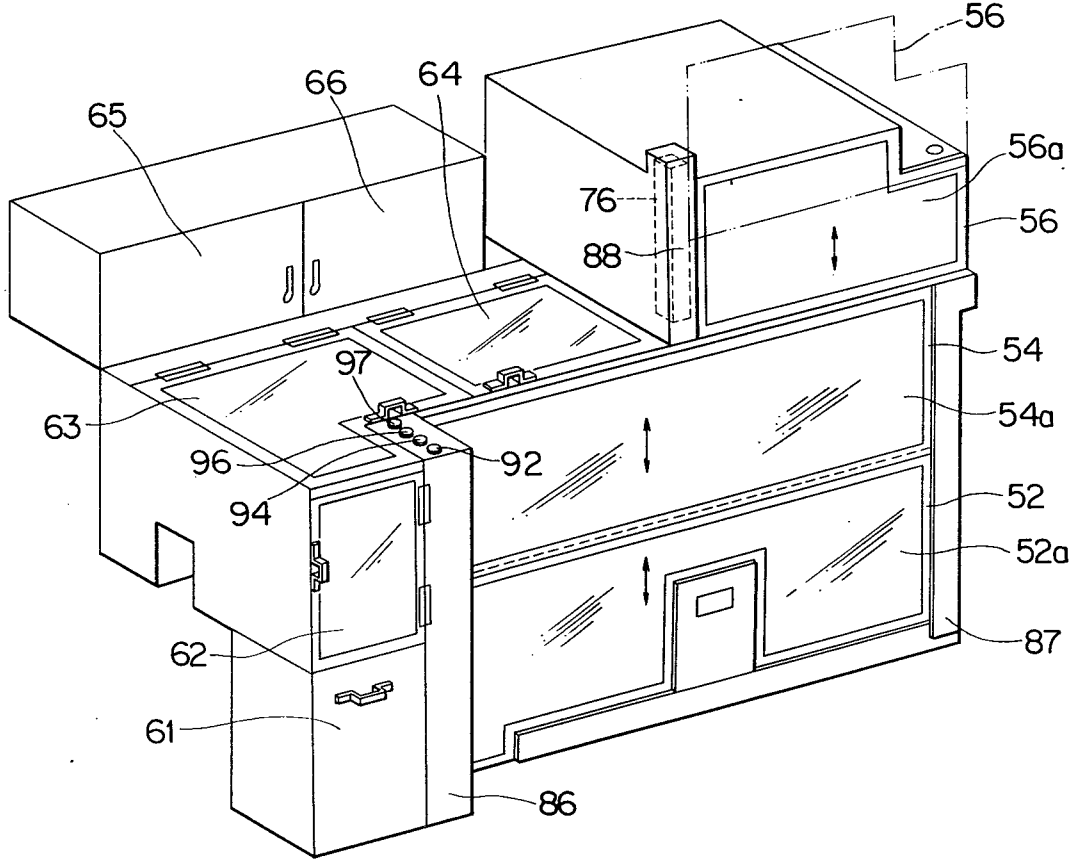
FIG. 8 is a perspective view of the apparatus of FIG. 1 in a wholly covered state.

FIG. 8 is a perspective view of a cover which covers the whole of the apparatus for reducing noise during operation of the tobacco filter tip attaching apparatus.

The illustrated cover is provided with first and second upwardly hinged doors 52 and 54 in positions corresponding to the right and left sides of the filter tip attaching portion 14 and the tip paper feed portion 24 located below them. Further, a third upwardly hinged door 56 is provided in a position corresponding to the filter tip feed portion 10 which is located above the filter tip attaching portion 14. In the main portions of the doors 52 to 56 are fitted, for example, acrylic resin plates to constitute see-through windows 52*a* to 56*a* so that the corresponding inside portions can be seen from the outside in a closed state of the doors.

The numerals 61 to 65 denote manually opened and closed doors. Since these doors have no direct bearing on the present invention, explanation thereon is here omitted.

Details of the construction for opening and closing the doors 52 to 56 will be explained below with reference to FIGS. 9 et seq.

Figure 9:
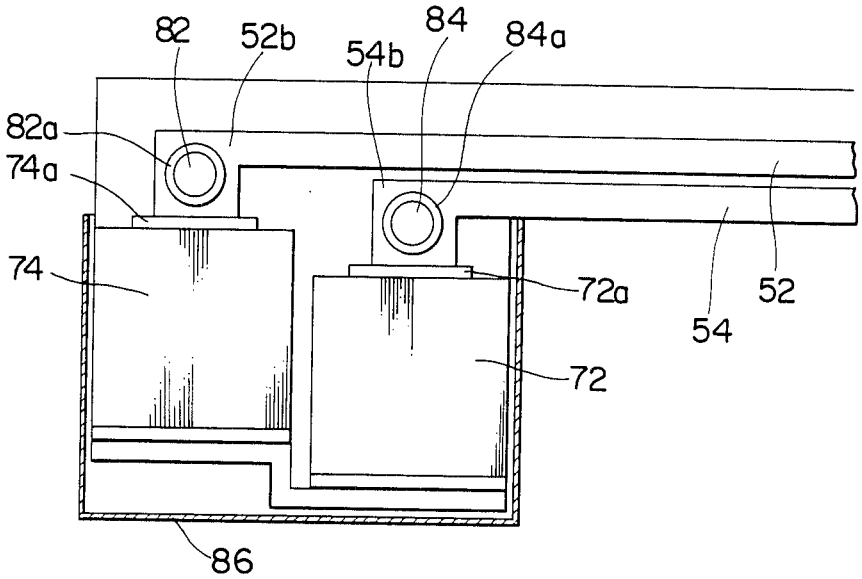
FIGS. 9 and 10 are detail views of a portion of FIG. 8.
Figure 10:
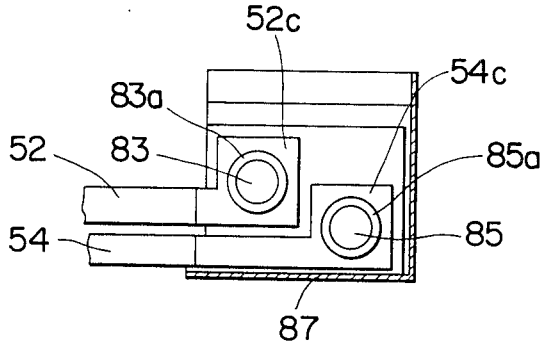

FIG. 9 is a top view illustrating drive cylinders 72 and 74 as drive sources provided correspondingly to the doors 52 and 54. To movable pieces 72*a* and 74*a* of the cylinders 72 and 74 are connected connecting arms 52*b* and 54*b* respectively which extend from one side edges of the doors 52 and 54. The connecting arms 52*b* and 54*b* are vertically guided through linear bearings 82*a* and 84*a* by guide bars 82 and 84 which are erected along the drive cylinders 72 and 74. The other side edges of the doors 52 and 54 are also partially extended as extensions 52*c* and 54*c* and vertically guided by guide bars 83 and 85 through linear bearings 83*a* and 85*a*. The cylinders 72, 74 and the guide bars 82, 84 are masked with a pillar-like decorative cover 86, while the guide bars 83 and 85 are masked with a plate-like decorative cover 87.

As to the door 56, an extension from its left side edge is connected to a movable piece of the drive cylinder 76 housed in a decorative cover 88 and is guided by a guide bar (not shown), and an extension from its right side edge is also guided by another guide bar (not shown).

Under the above construction, the doors 52, 54 and 56 are moved vertically in the directions of arrows as illustrated by the operation of the drive cylinders 72, 74 and 76 corresponding respectively to those doors.

On the upper surface of the pillar-like decorative cover 86 are provided three manually operating button switches 92, 94 and 96 for operating the drive cylinders corresponding to the doors to open and close the doors manually each independently, as well as a closing button switch 97 for simultaneously closing all of the doors opened automatically.

Figure 11:
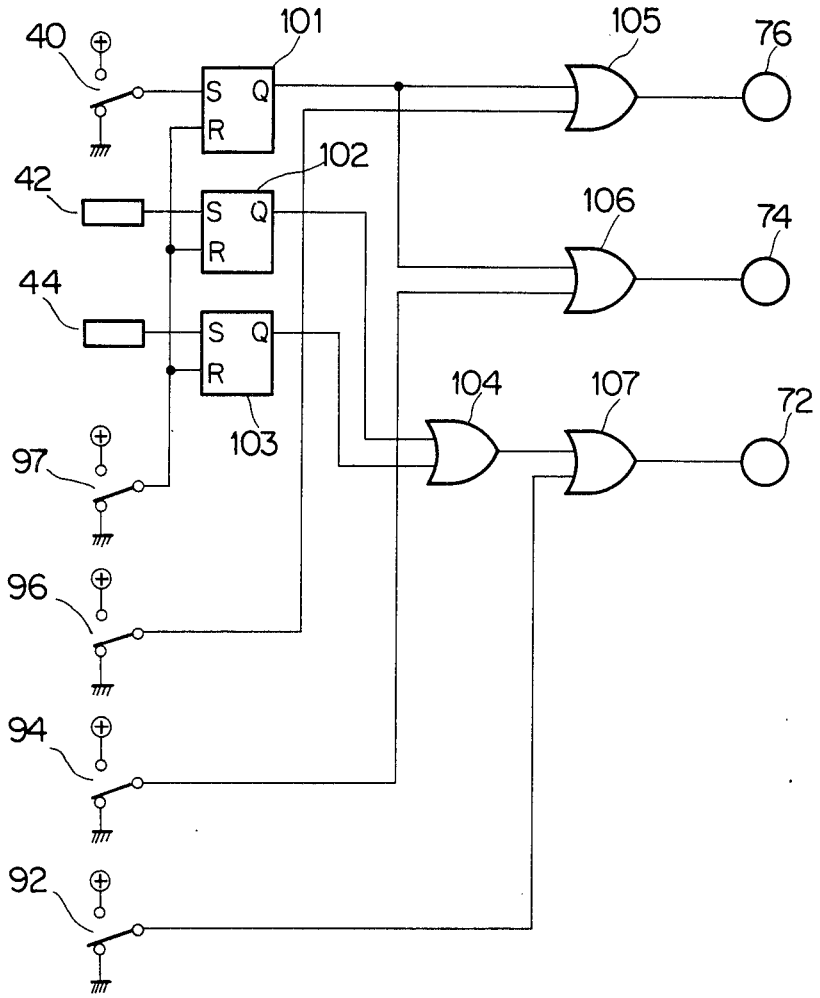
FIG. 11 is a circuit diagram showing an example of a control circuit.

FIG. 11 illustrates a control circuit which produces signals for actuating the cylinders 72–76 corresponding respectively to the doors 52–56 in accordance with signals provided from the sensors 40–44 and operating button switches 92–97. Operation of this circuit will be described below.

When the sensor 40 detects a stoppage of feed of filter tip to the filter tip attaching portion 14 and produces an output signal of H level, an R-S flip flop (FF) 101 is set in response to the leading edge of the signal and its output Q goes from L to H level. As a result, the outputs of OR gates 105 and 106 become H level, and the cylinders 76 and 74 are actuated in the direction of opening the doors 52 and 54, so the doors 52 and 54 are simultaneously opened automatically. Therefore, the operator can immediately judge the cause of discontinued feed of filter tips and replenish filter tips into the hopper 10*a* if there are not tips therein, or remove filter tips if the tips are the cause of clogging of the passage. When the apparatus is restarted after removal of such obstacle, it is operated at a low speed, so whether filter chips are fed smoothly or not is checked at this stage, and if there is no problem, the high-speed operating button switch 97 is pushed, whereby the FF 101 is reset to produce an L-level signal at its output terminal Q. As a result, the outputs of the OR gates 105 and 106 which have been H level become L level and the cylinders 76 and 74 revert to the original closed state, so the doors 56 and 54 are closed simultaneously.

Next, when the sensor 42 produces a signal of H level upon detection of a cutting of the tip paper, the R-S FF is set to produce an H-level signal. As a result, the outputs of the OR gates 104 and 107 become H level and the cylinder 72 is actuated in the opening direction by the output of the OR gate 107, so the door 52 is opened automatically. Thus, the work of resetting the fore end of tip paper to the predetermined position can be done at once. If the operation is restarted after this setting work and then after a while the high-speed operating button switch 97 is pushed, the FF 102 is reset and its output Q becomes L level, whereby the cylinder 72 is operated in the direction of closing the door 52.

Further, when it is detected by the sensor 44 that the diameter of the tip paper roll 25 in the tip paper feed portion 24 has become smaller than the predetermined value, the R-S FF is set to produce an H-level signal at its output terminal Q. As a result, the outputs of the OR gates 104 and 107 become H level and the cylinder 72 adapted to be controlled by the output of the OR gate 107 is operated in the opening direction, so the door 52 is opened automatically. Thus, the operator can immediately perform the work of rotating the support frame 24*b* so that the tip paper roll reduced in diameter shifts to the right-hand side, then loading a new tip paper roll in the left-hand position and subsequently performing the setting for automatic connection between tip papers. During this work, it is not always necessary for the apparatus to stop operation, and the apparatus may be in a state of low-speed operation. If the high-speed operating button switch is pushed after completion of the required work, the FF 103 is reset, whereupon the door 52 is closed automatically by the cylinder 72.

The button switches 92 to 96 comprise change-over switches which, for example, switch to one side upon one depression and to the other side upon another depression. According to the state of operation of each button switch, the corresponding door is opened or closed.

According to the present invention, as set forth hereinabove, since the whole of the machine is covered, it is possible to greatly reduce noise induced by the filter tip attaching apparatus during high-speed operation. Besides, since the doors corresponding to various portions of the apparatus which require operations by the operator for coping with clogging caused by filter tips, cutting of tip paper and automatic connection between tip papers, can be opened automatically, the troublesome work of judging the door to be opened and opening it manually during operation is no longer necessary, thus greatly improving the working efficiency.

What is claimed is:

1. A tobacco filter tip attaching apparatus including:

(a) a filter tip attaching portion having means for rolling and pasting a tip paper onto both one end portion of a cigarette and a filter tip disposed adjacent said one end portion;

(b) a filter tip feed portion disposed in the vicinity of said filter tip attaching portion having means for feeding filter tips to said filter tip attaching portion;

(c) a tip paper feed portion disposed in the vicinity of said filter tip attaching portion having means for feeding a tip paper from a tip paper roll to the filter tip attaching portion;

(d) a filter tip sensor means for detecting that the feed of filter tip from said filter tip feed portion to said filter tip attaching portion is discontinued;

(e) a tip paper cutting sensor means for detecting a cutting accident of the tip paper during feed from said tip paper portion to said filter tip attaching portion;

(f) a roll diameter sensor means for detecting that the diameter of the tip paper roll in said tip paper feed portion has become smaller than a predetermined value;

(g) the whole of the apparatus being covered with a cover, said cover being provided with openable doors in positions corresponding respectively to said filter tip feed portion, filter tip attaching portion and tip paper feed portion; and (h) power sources source means provided in corresponding relation to said doors are operated selectively in accordance with output signals provided from said sensor means to open one or more of said plural doors automatically.

* * * * *